US008443554B1

(12) United States Patent
Teodorovich

(10) Patent No.: US 8,443,554 B1
(45) Date of Patent: May 21, 2013

(54) VARIABLE SIZE DOOR AND WINDOW SILL PAN WITH DRAIN

(76) Inventor: Mishko Teodorovich, Austin, TX (US)

( * ) Notice: Subject to any disclaimer, the term of this patent is extended or adjusted under 35 U.S.C. 154(b) by 233 days.

(21) Appl. No.: 12/896,935

(22) Filed: Oct. 4, 2010

Related U.S. Application Data

(63) Continuation-in-part of application No. 11/404,540, filed on Apr. 14, 2006, now abandoned.

(60) Provisional application No. 60/671,182, filed on Apr. 14, 2005, provisional application No. 60/695,194, filed on Jun. 29, 2005.

(51) Int. Cl.
*E05F 11/00* (2006.01)

(52) U.S. Cl.
USPC ..... 49/506; 52/58; 52/60; 52/105; 52/204.5; 52/217; 52/204.54; 52/504.56

(58) Field of Classification Search
USPC ..... 49/506, 467, 468; 52/58, 60, 105, 52/204.5, 209, 210, 211, 217, 204.54, 204.56, 52/204.53
See application file for complete search history.

(56) References Cited

U.S. PATENT DOCUMENTS 5,222,345 A * 6/1993 Riley ..... 52/783.19
5,653,072 A * 8/1997 Seelandt-Stasek et al. .. 52/204.1
6,269,591 B1 * 8/2001 Kelly ..... 49/482.1

* cited by examiner

*Primary Examiner* — Jerry Redman
(74) *Attorney, Agent, or Firm* — Rick B. Yeager

(57) ABSTRACT

A variable size sill pan can be adapted to various widths, lengths, and heights of framed door or window openings. The sill pan assembly includes an extruded base which is typically inclined, window or door supports which can be extruded as part of the base unit, and molded corner elements. Grooves are provided on the front flange of the sill pan base to permit the front flange to be cut to a desired length. Grooves are provided on the rear sill pan wall permit the rear sill pan wall to be cut to a desired length. Grooves or markings are provided on a base and on end cap sections to permit the pieces to the cut to a desired width. An assembled sill pan is formed by attaching the adjusted pieces together, or by snapping and gluing the adjusted pieces together.

11 Claims, 27 Drawing Sheets

FIG. 1- PRIOR ART

FIG. 2- PRIOR ART

FIG. 3- PRIOR ART

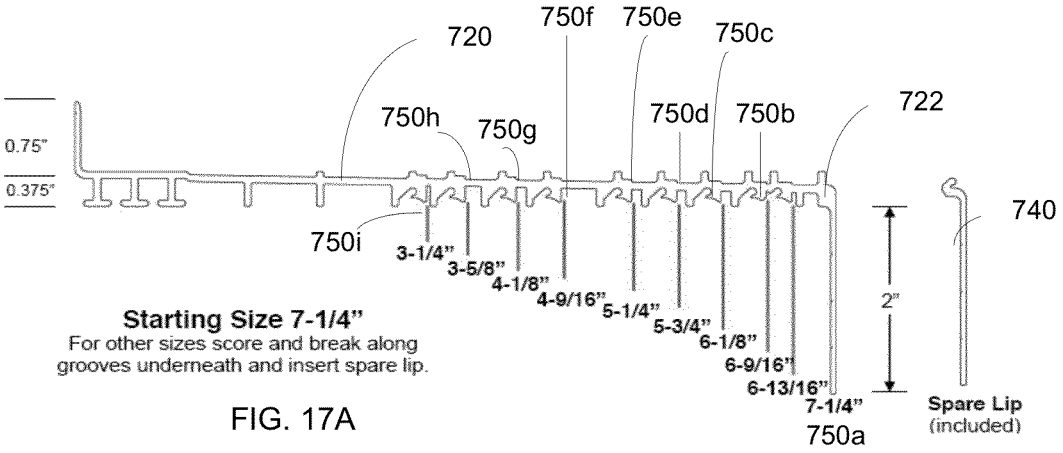
FIG. 17A
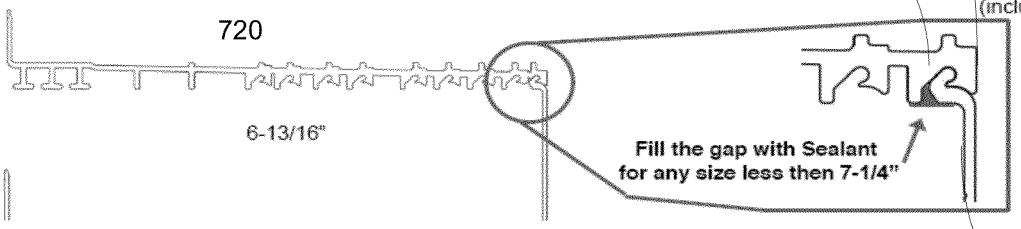
FIG. 17B
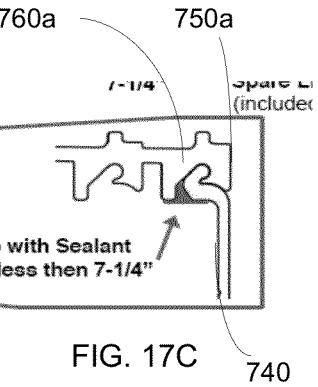
FIG. 17C
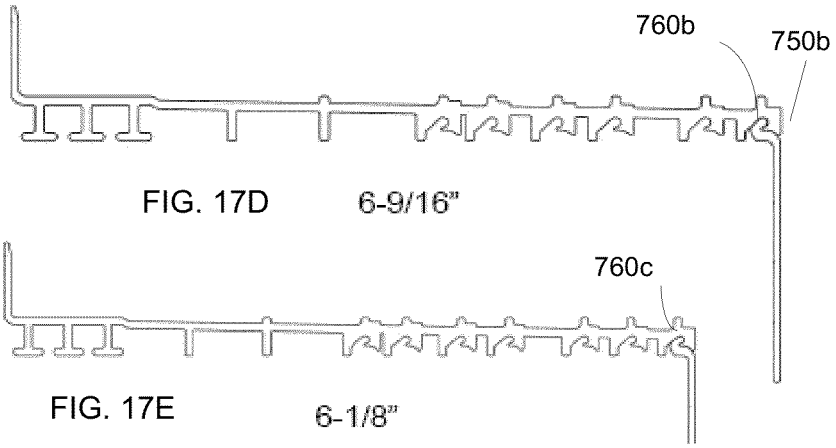
FIG. 17D 6-9/16"
FIG. 17E 6-1/8"

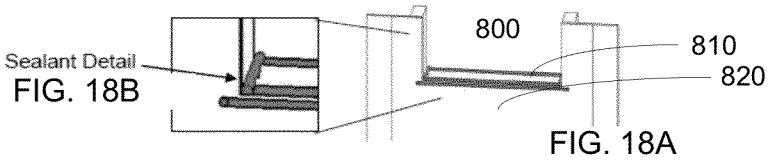
FIG. 18B
FIG. 18A
FIG. 18D
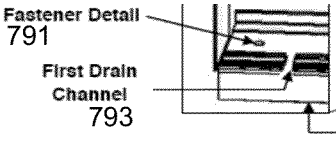
FIG. 18C
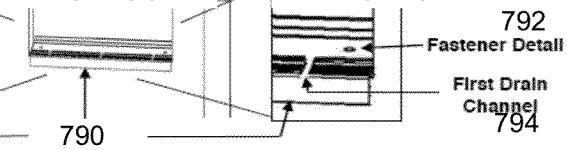
FIG. 18E
FIG. 18G
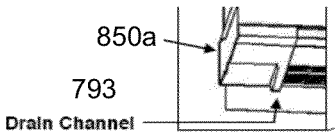
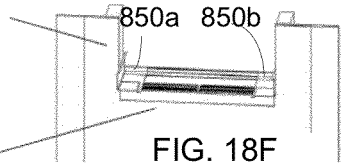
FIG. 18F
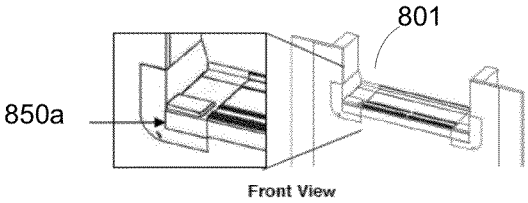
FIG. 18H
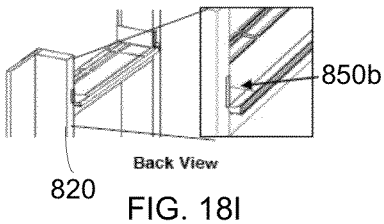
FIG. 18I

VARIABLE SIZE DOOR AND WINDOW SILL PAN WITH DRAIN

RELATED APPLICATIONS

This application is a continuation-in-part of U.S. patent application Ser. No. 11,404,540 filed Apr. 14, 2006 now abandoned which is related to U.S. Provisional Application No. 60/671,182 filed Apr. 14, 2005 and U.S. Provisional Application No. 60/695,194 filed Jun. 29, 2005; and claims the benefit of those application dates.

FIELD OF INVENTION

This invention relates to a sill, sill pan flashing, sill pan, or sill pan flashing for a door or window, where the sill pan drains accumulated moisture.

BACKGROUND

It is desirable to provide a relatively low cost window and door sill pan with pan flashing for directional drainage of water and moisture which can be used for construction in all price ranges of housing, and for any door or window width. In one embodiment of the current invention, a base unit is provided which can be manufactured by extrusion and either cut to a desired length to fit the door or window width opening, or used with other similar elements and connectors to establish a desired final length. End pieces and optional center joining elements are provided for field assembly.

The prior art includes U.S. Pat. No. 5,921,038 to Burroughs which describes a window sill pan with an inclined plate and ribs perpendicular to the front edge. The patent includes a front cover, but does not disclose end members.

U.S. Pat. No. 6,385,925 B1 to Wark teaches an inclined plate with ribs perpendicular to the front edge. The Wark patent does not include a cover, but does have end members. Wark also describes the possible use of other window support means such as truncated cones. Wark describes the supports as being on the apparently solid inclined base.

U.S. patent application Ser. No. 10/730,414 filed Dec. 8, 2003 by applicant published as Application 20050055912 is incorporated by reference herein. That application describes a sloped sill pan assembly.

It is desirable to provide a common size of sill pan so that the pan may be manufactured economically and so that stocking complexity can be reduced. There is a need for several different sizes of sill pan. Some sizes may not be prevalent sizes in industry to provide large enough sale volume for fixed size pans. In this specification, the term "size" or "width" refers to the depth of the sill or sill pan which is typically a few inches; and the term "length" refers to the longer dimension of the opening, which is typically a few feet. There is a need for a sill pan assembly that can be adapted to various widths, lengths, and heights.

SUMMARY

The current invention is for a window sill pan or door sill pan flashing. In some embodiments of the current invention, the device can be made in a low cost manufacturing operation by extrusion. In one embodiment, SureSill™ is made by combining extrusion and injection molding processes. The sill pan typically includes an inclined base, window or door supports which can be extruded as part of the base unit, and corner elements which can be snapped or otherwise attached to the base.

In one embodiment, grooves are provided on the front flange permit the front flange to be cut to a desired length, and grooves are provided on the rear sill pan wall permit the rear sill pan wall to be cut to a desired length.

In one embodiment, grooves or markings are provided on a base and on end cap sections to permit the pieces to the cut to a desired width. An assembled sill pan is formed by attaching the adjusted pieces together, or by snapping and gluing the adjusted pieces together.

In other embodiments, the sill pan base is adjusted to a desired width by removing a portion of the base along a selected score groove, and a spare front lip is installed on the sill pan base.

In some embodiments, rigid corner elements are used. In other embodiments, the corners are sealed with a membrane or an adhesive.

BRIEF DESCRIPTION OF THE DRAWINGS

These and other objects and advantages of the present invention are set forth below and further made clear by reference to the drawings, wherein:

FIG. 17A is a side view of an example 7¼" embodiment of a variable size sill pan base and a spare lip. This FIG. shows a plurality of scoring grooves to permit the sill pan base to be cut or broken to a desired depth.

FIG. 17B is a side view of the sill pan base of FIG. 17A broken or cut along the 6¹³⁄₁₆" score groove, and the spare lip inserted into the 6¹³⁄₁₆" lip groove.

FIG. 17C is a detailed side view of the end of the sill pan base of FIG. 17A, the spare lip inserted, and a sealant applied along the gap where the spare lip is inserted into the 6¹³⁄₁₆" lip groove.

FIG. 17D is a side view of the sill pan base of FIG. 17A broken or cut along the 6⁹⁄₁₆" score groove, and the spare lip inserted into the 6⁹⁄₁₆" lip groove.

FIG. 17E is a side view of the sill pan base of FIG. 17A broken or cut along the 6⅛" score groove, and the spare lip inserted into the 6⅛" lip groove.

FIG. 18A is a front perspective view of a sealant applied to the bottom and front of a rough opening.

FIG. 18B is a detailed front perspective of a corner of the rough opening of FIG. 18A.

FIG. 18C is a front perspective view of a sill pan base positioned in the bottom of the rough opening of FIG. 18A.

FIG. 18D is a detailed front perspective of the left corner of the sill pan base of FIG. 18C, showing a fastener location and a first drain channel on the left side of the sill pan base.

FIG. 18E is a detailed front perspective of the right corner of the sill pan base of FIG. 18C, showing a fastener location and a first drain channel on the right side of the sill pan base.

FIG. 18F is a front perspective view of a Self Adhering Flashing applied to the left and right ends of the sill pan base of FIG. 18C.

FIG. 18G is a detailed front perspective view of the Self Adhering Flashing applied to the left end of the sill pan base of FIG. 18C and to the inside of the left bottom corner of the rough opening.

FIG. 18H is a front perspective view of the Self Adhering Flashings folded over portions of the side and bottom of the rough opening.

FIG. 18I is a detailed front perspective view of the left corner Self Adhering Flashing folded over portions of the side and bottom of the rough opening.

DETAILED DESCRIPTION OF EMBODIMENT

Variable Height Plastic Sill Pan with Extruded Base Cut to Desired Length

Prior Art—SureSill™ Sloped Sill Pan

FIGS. 1-5 show a prior art sloped sill pan as described in published Application 20050055912 by applicant.

Figure 1:
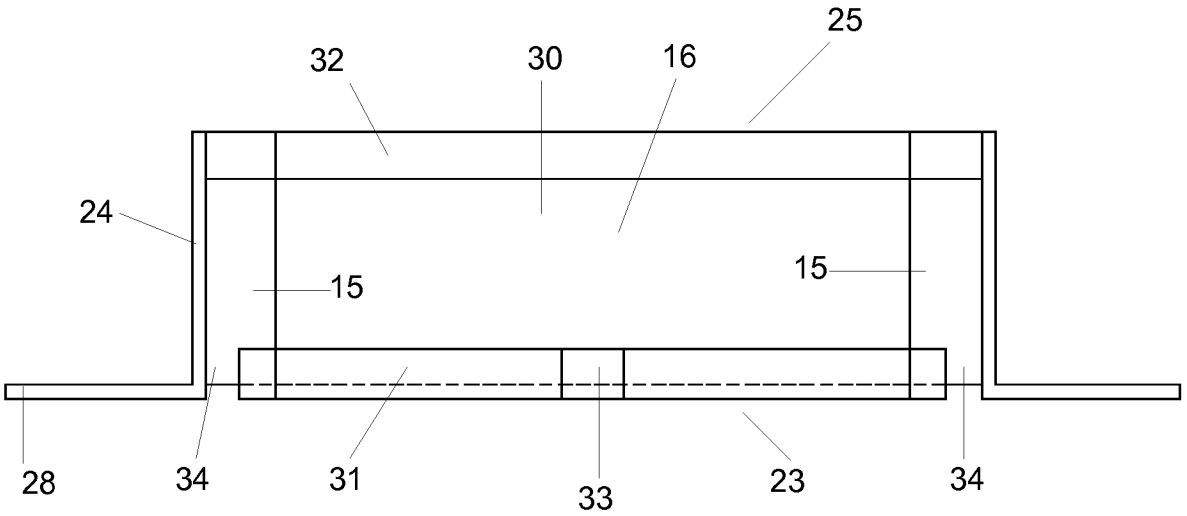
FIG. 1 is a prior art top view of an embodiment of a sill pan assembly.

Referring now to FIG. 1 which is a top view of a single sill pan, the sill pan includes a base 30 with a downwardly sloping top surface. The sill pan has a front support ridge 31 and a rear support ridge 32 for supporting a window or door. In this embodiment the sill pan includes an extruded middle piece 16, or lock-in channel plate, and end pieces 15, or, lock-in corners, which may be molded or provided by other manufacturing processes. Pieces are typically joined with cement such as PVC glue or with a snap together feature.

Figure 2:
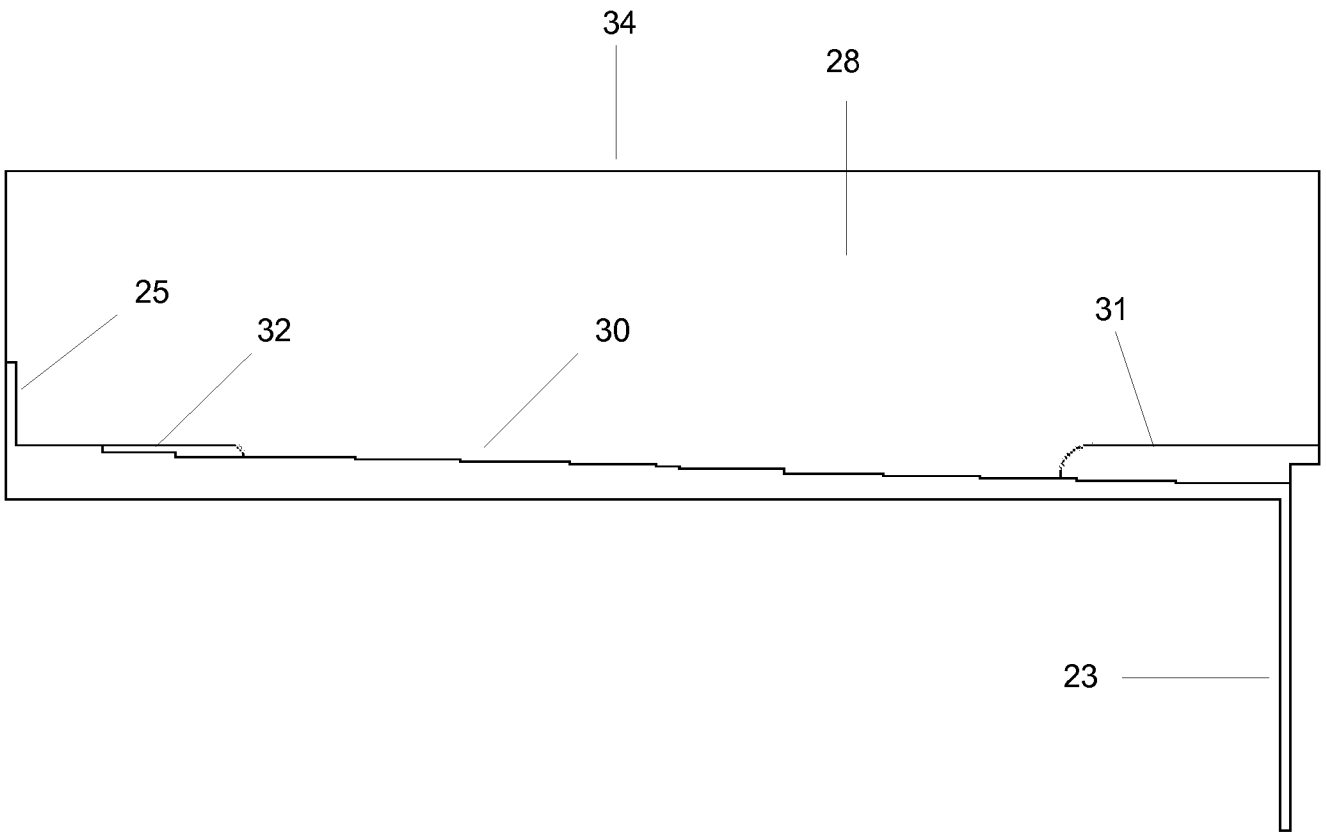
FIG. 2 is a prior art side cross section view of the embodiment of FIG. 1.

Referring now to FIG. 2 which is a side view of the sill pan embodiment of FIG. 1, the base 30 has a slope from the rear portion of the sill pan to the front portion The front support ridge 31 is solid through the base so that it rests on the bottom and the rear support ridge 32 is also solid, thereby transmitting the weight of the window or door to the support area for the sill. Wall thickness for the walls can be approximately ⅛ of an inch thick. In one embodiment the front support pedestal has a width of approximately ¾ of an inch, and the rear support pedestal has a width of approximately 1 inch.

As shown in the FIGS. 1 and 2, this embodiment includes a rear wall 25 and a downward extending lip 23. The rear wall may include offsets (not shown) to provide a drain path between the rear wall and the window or door. The downward extending lip 23 may include an offset to provide a drain path between the sill pan and the siding or other materials installed around the window or door. These offsets create a drain path for moisture which might become present in the sill.

In this embodiment the front ridge may further include a gap 34 between the support ridge and the sides and may further include a drain channel 33 to permit the drainage of moisture. The corner pieces include a side upward lip 24 and a downward lip 28.

Figure 3:
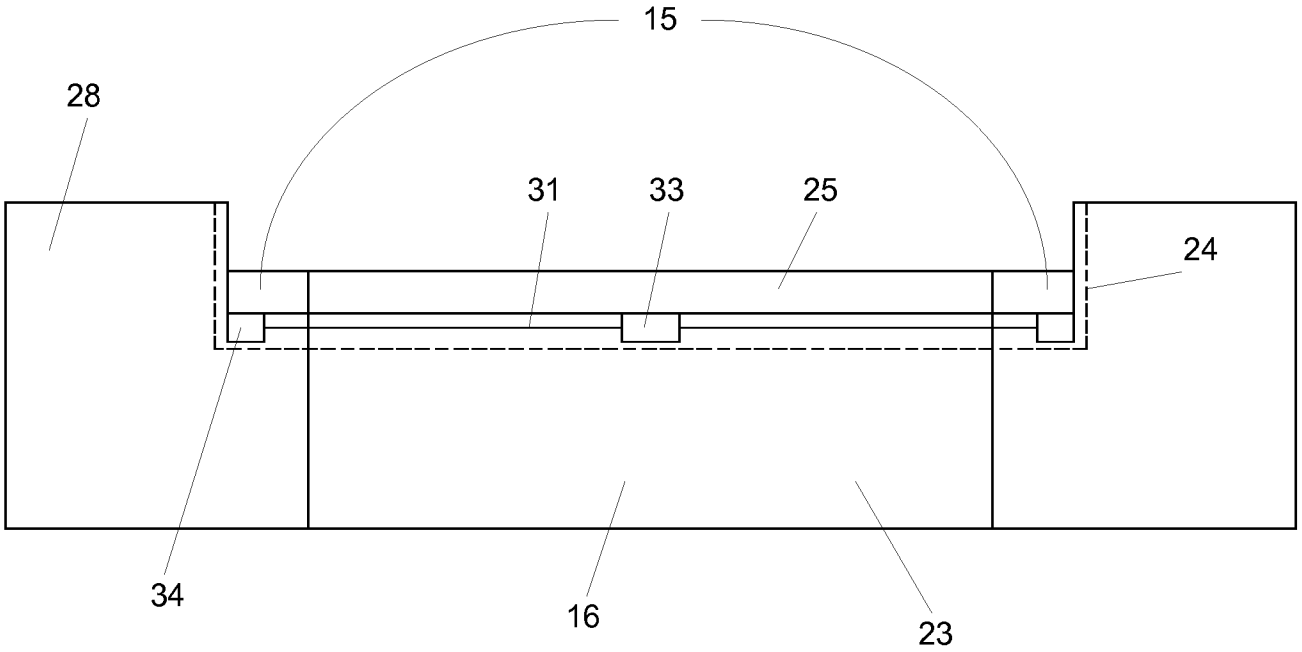
FIG. 3 is a prior art front view of the embodiment of FIG. 1.

Referring now to FIG. 3 which is a front view of the embodiment of FIG. 1, the front support ridge 31 includes gaps 33 and 34 for drainage.

Figure 4:
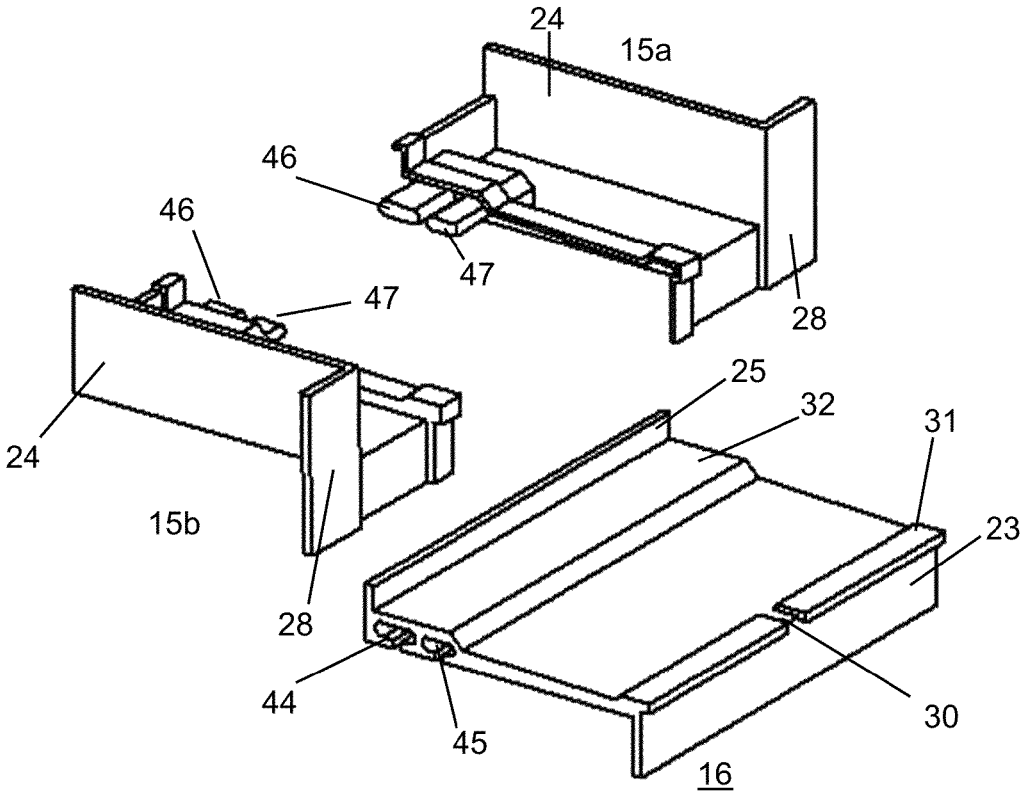
FIG. 4 Prior Art
FIG. 4 is a prior art exploded view of an embodiment with a base element and corner elements.

FIG. 4 is an exploded view of an embodiment with a base element and end elements. In this case the extruded middle piece 16 includes a first channel 44 and a second channel 45. The right corner element 15A includes a first tab 46 which fits into the first channel 44, and a second tab 47 which fits into the second channel 45. The left corner element 15B also includes a first tab 46 which fits into the first channel 44, and a second tab 47 which fits into the second channel 45. The tabs and channels create an interlocking between the middle piece and the corner elements.

Figure 5:
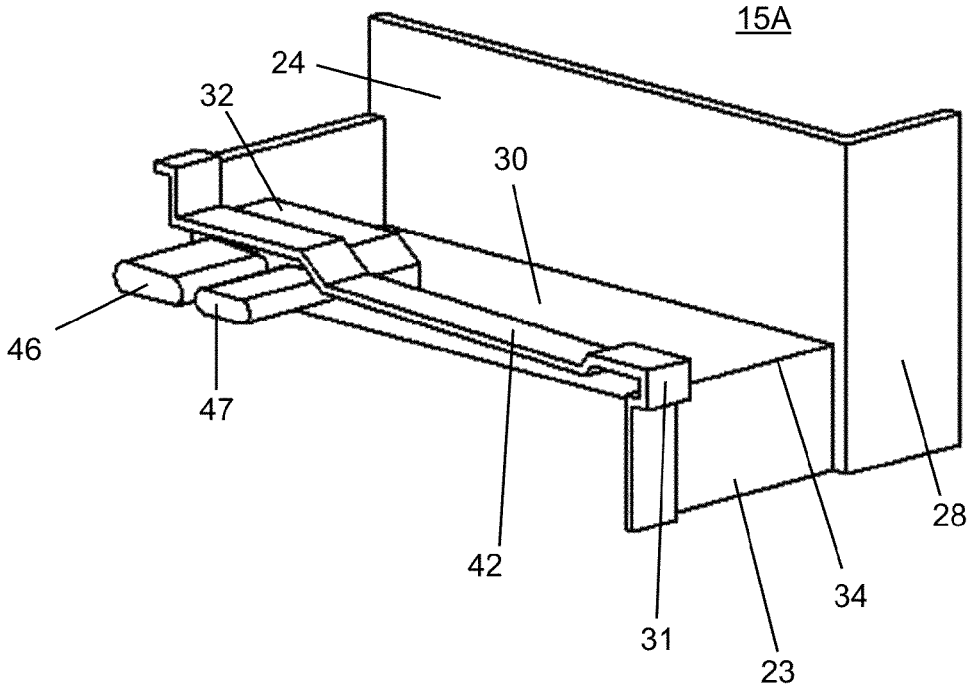
FIG. 5 Prior Art
FIG. 5 is prior art enlarged detail perspective view of the right end element of the embodiment of FIG. 4.

FIG. 5 is an enlarged detail view of the right end element 15A of the embodiment of FIG. 4. In this embodiment, the corner element includes a first tab 46 or alignment extension which may be inserted into the first channel 44 in the base portion; a second tab or alignment extension 47 may be inserted into the second channel 45 in the base portion; and an overlapping lip 42.

Variable Height Rear Wall

The sill pan is designed to collect and discharge the moisture from the window or door rough opening of a structure. The rear wall 25, right corner element 15A, and left corner element 15B provide three upward lips which act as dams to direct the water to drain over the front lip 23 to the exterior of the structure.

During wind driven rain, strong wind can drive the rain over the back dam or rear wall 25 and into the interior of the building. To prevent this back-blow, an adhesive sealant can be applied between the sill and the back dam 25. Another approach is to provide a back dam can be sufficiently high, so that the water would not go over the back dam in a driving wind.

It is desirable for the back dam to vary in height in order to accommodate different wind conditions and different sill heights for door and window applications. The sill heights limit the height of the back lip, because it is not practical for the back lip to extend above the sill, or above the window casing.

In one embodiment of the current invention, one or more rear wall height adjustment indicator, such as one or more lateral grooves is provided in the rear wall 25. This rear wall height adjustment indicator provides a breaking, scoring or cutting line for the rear wall. The rear wall may be breakable by hand or by tool along a groove; or a knife blade can be run in the desired groove, thereby deepening the cut and allowing for easier breakage and smoother breaking edge or cutting of the rear wall lip. This ability to remove a portion of the rear wall provides a height adjustability to the sill pan. The grooves can be introduced on one or both sides of the lip. Also, different wall thickness can be used with or without grooves as another way to delineate the steps of different height. Similar marking and grooving techniques can be used with a front lip height adjustment indicator.

The grooves can also be introduced on the end cap corner elements 15A and 15B if desirable. Generally however, the end caps are covered by casing and drywall, and it is not necessary to cut them down or to reduce the height of the sections that are receiving the base section, because the end caps are not visible on the inside of the finished building. If the end caps are visible on the inside of the finished building, it will be preferable for the visible part of the caps to be trimmed so that the visible section of the sill pan would have all parts the same height.

In one embodiment of the current invention, the height of the face of the front flange and height of the rear wall of the sill pan may be adjusted to accommodate various field application requirements.

Figure 7A:
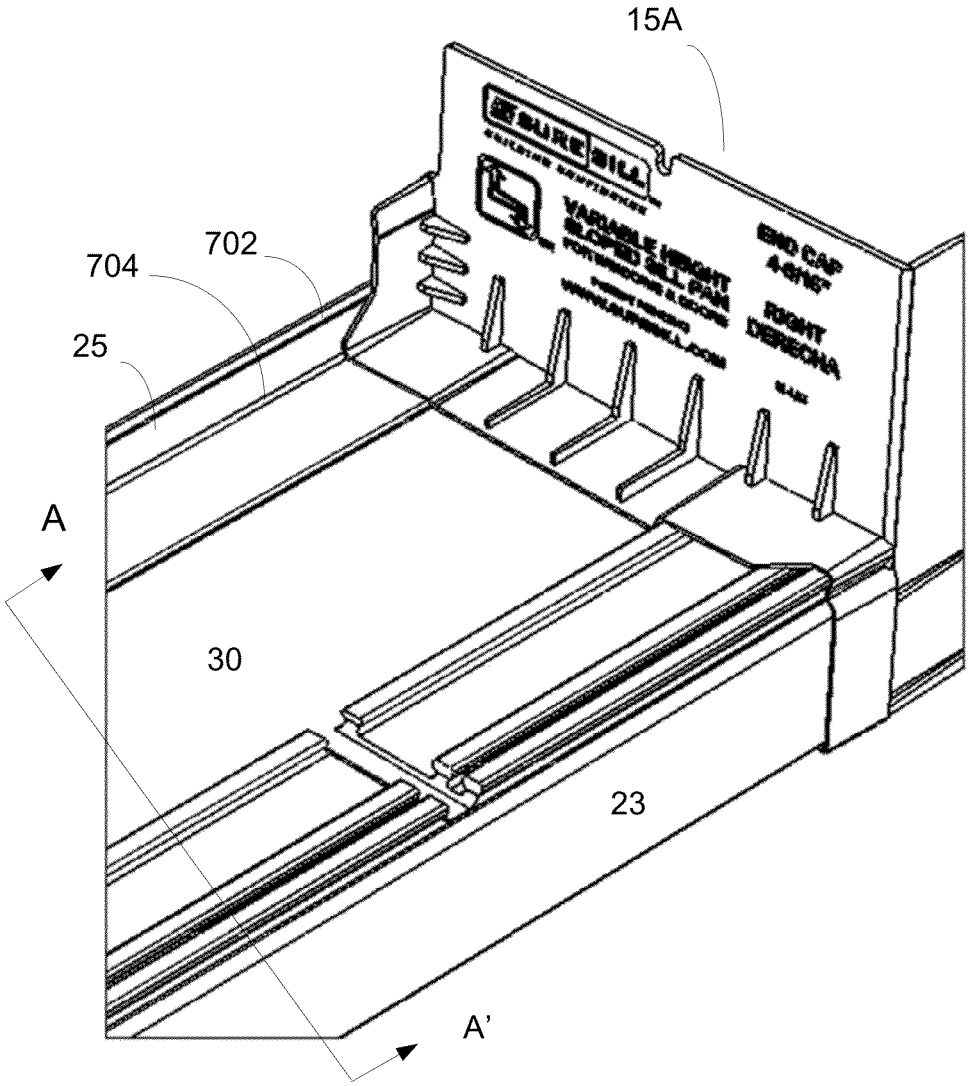
FIG. 7A is a right side front perspective view of a rear sill pan wall with grooves.
Figure 7B:
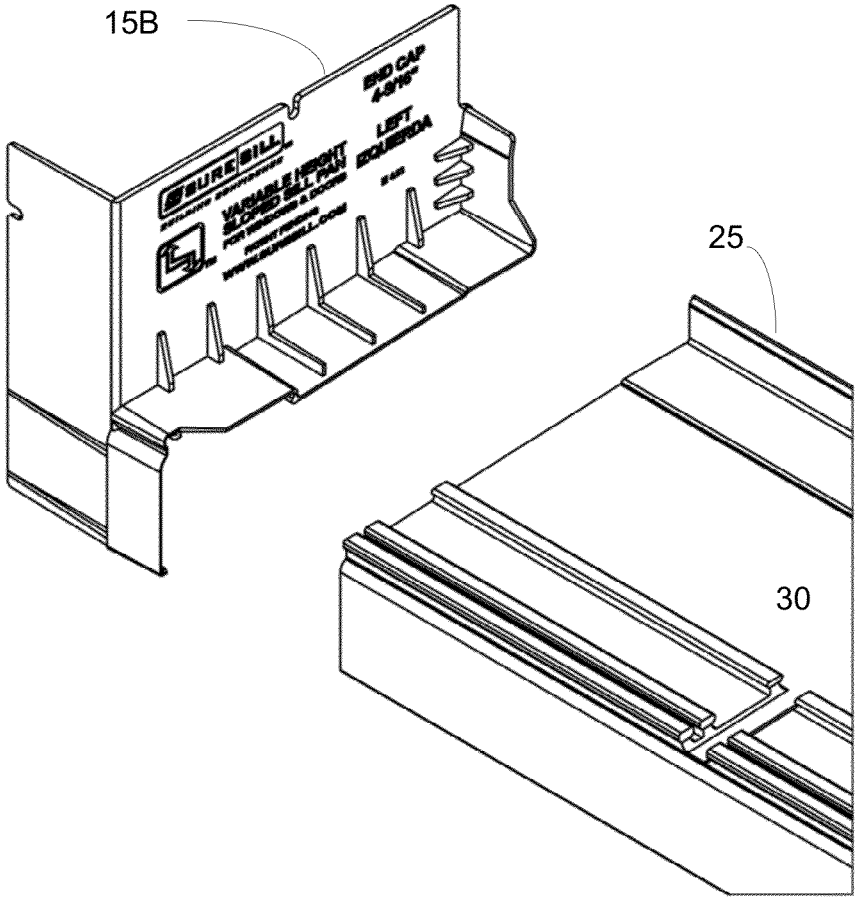
FIG. 7B is an exploded left side front perspective view of a rear sill pan wall with grooves.

FIGS. 7A-7E is a right side front perspective view of a rear sill pan wall with grooves. FIG. 7B is an exploded left side front perspective view of a rear sill pan wall with grooves. In one embodiment, the Variable Depth Sill Pan™ is designed for installation in a 4⅛" wall size which includes 2×4 studs, ½" drywall, and felt paper on the outside of the studs. The SureSill Sloped Sill Pan for Windows and Doors may have a variable depth in this 4⅛" wall size. The rear sill pan wall can vary in height, and can be shortened in the field. In FIGS. 7A and 7B, two grooves 702 and 704 in the rear sill pan wall 25. In this example, the rear wall height is 1.2 inches, the first groove 702 is located at a height of about ⅝" from the rear of the base 30, and the second groove 704 is located at a height of about ¾" from the rear of the base 30. The number and location of these height adjustment grooves may be varied as desired.

A taller rear sill pan wall provides additional protection for higher wind speed that would drive the rain sideways. The wind driven rain can cause a blow back of water under the door and over a shorter rear sill pan wall and into a building. A rear sill pan wall height of 1.2" provides protection of up to 45 mph wind speed, or 40 mph wind speed with a safety margin to allow for actual installation conditions such as unleveled installation. A reference standard for rear sill pan wall height relative to wind speed is ASTM E 2112-A3.

For some applications, such as in-swing doors with standard door sill, a 1.2" rear lip works well. For other applications, a tall lip may not be needed, or may not work well. For instance, if out-swing doors have a rear sill pan wall taller than ⅝", in most applications the rear sill pan wall will stick above the door sill on the interior side. In another example, windows having a rear sill pan wall taller then ¾" may have the rear sill pan wall stick above the window casing, or the window stool. In some instances, the rear sill pan wall will protrude above the window jamb/sash on the interior side. In some applications, a tall rear lip may pose a hazard or have unappealing look.

In order to adjust the height of the rear sill pan wall, the wall may be scored with a knife along a groove. In various examples, the wall may be cut at the groove, the groove can provide a snap feature so that the wall may be broken along the groove, or the groove may be scored with a knife and then broken along the groove.

The mating teeth on end caps are longer than the overlap, and are chamfered on the leading edge for easier fit.

Figure 7C:
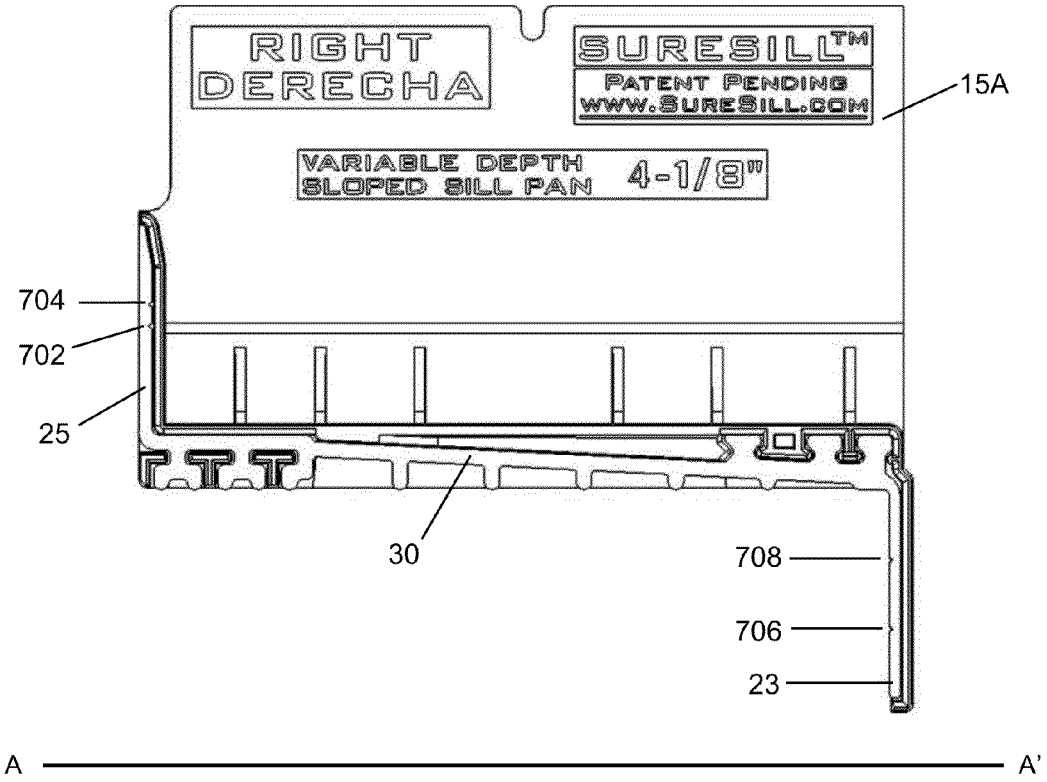
FIG. 7C is a cross sectional view of the right side of the sill pan of FIG. 7A.
Figure 7D:
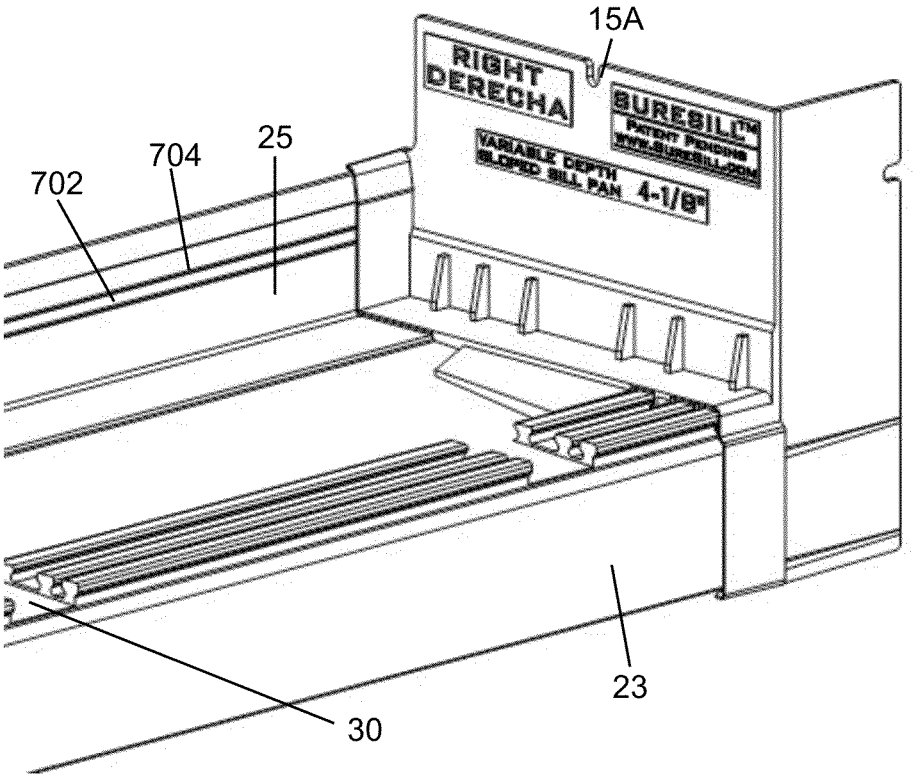
FIG. 7D is a right side front perspective view of the sill pan of FIG. 7A.
Figure 7E:
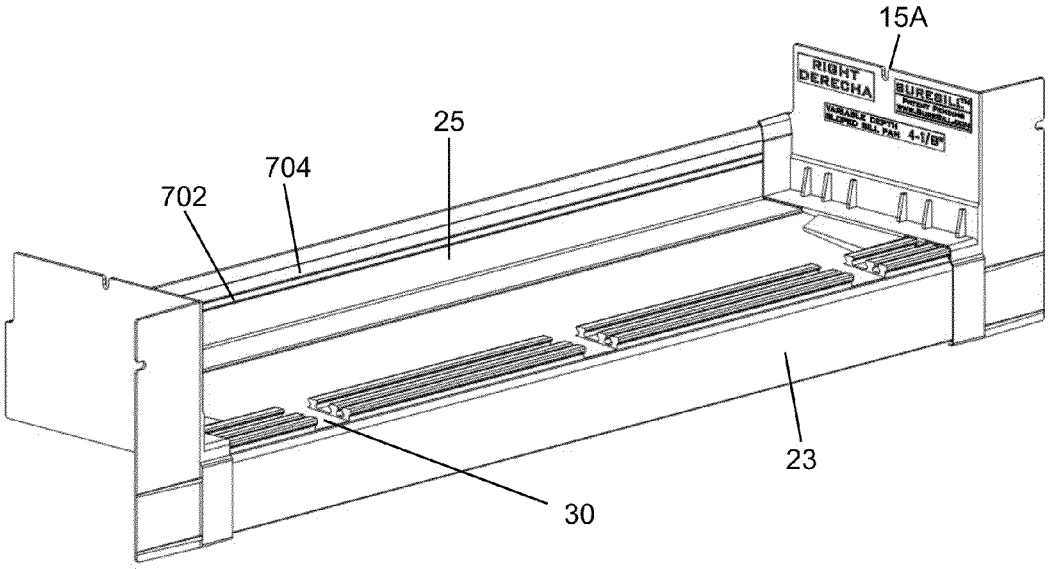
FIG. 7E is a front perspective view of a complete sill pan of FIG. 7A.

Additional details of one example embodiment of an adjustable height sill pan is shown in FIGS. 7C-7E. FIG. 7C is a cross sectional view of the right side of the sill pan of FIG. 7A. FIG. 7D is a right side front perspective view of the sill pan of FIG. 7A. FIG. 7E is a front perspective view of a complete sill pan of FIG. 7A.

Variable Height Front Lip

Figure 6:
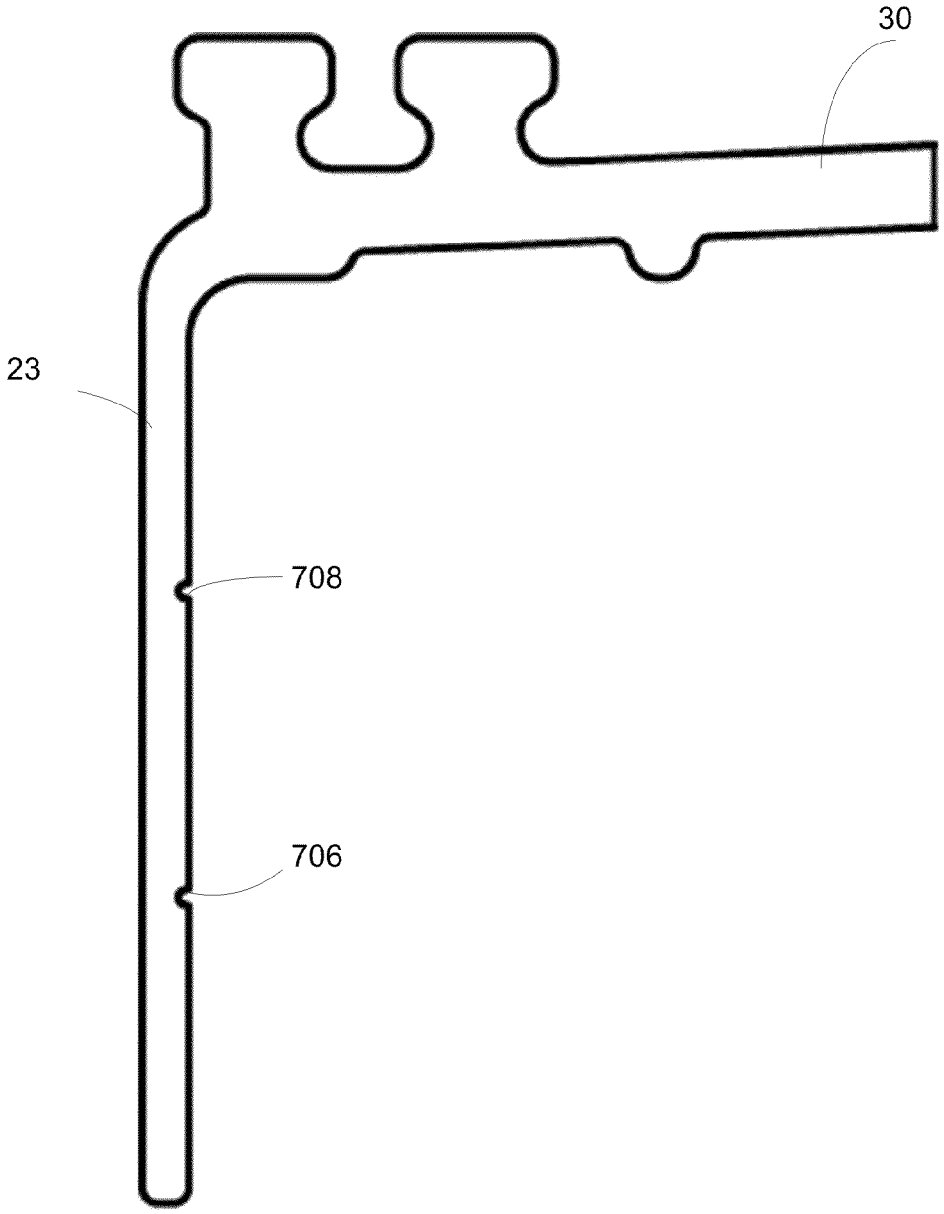
FIG. 6 is a side view of a front flange with grooves.

Similar height adjustment grooves may be provided in the front lip 23. FIG. 6 is a side view of a front flange with grooves. In this example, the front flange has 2 grooves 708 and 706 to support most available door sills, and for better support of windows. FIG. 7C also shows these example front flange height adjustment grooves 708 and 706. These grooves to allow the pan installation in applications where there is not enough clearance for the entire front lip to fit. One example is a front porch where there in not enough drop between a house concrete or plywood sub-floor level and a concrete porch.

DETAILED DESCRIPTION OF EMBODIMENT

Variable Size Sloped Sill Pan

Different wall construction, jamb, or sill size, requires different widths of the sill pan. It is desirable for a sill pan to have a range of sizes over which it can be used. One embodiment of the current invention provides for variation in width from 5¼" to 8" wide sill pan.

Figure 8:
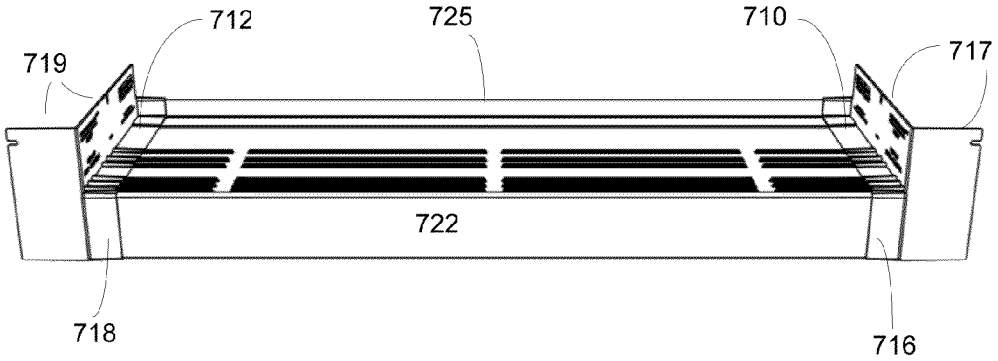
FIG. 8 is a front perspective view of assembled variable width sill pan.

FIG. 8 is a front perspective view of an assembled seal pan. The parts include a right end cap base 710, a left end cap base 712, a right end cap front 716, a left end cap front 718, a channel plate base 720 with a rear wall 725, and a front lip 722.

This embodiment describes a sill pan which is provided in a first size, such as the largest size, and which can be narrowed to a desired size by removing a portion of the sill pan along a selected width indicator. In this example, the base of the sill pan is typically provided as an extrusion with a width of a large common sill size, and the end pieces are provided in similar widths. The end pieces are typically manufactured by injection molding or other manufacturing process. Smaller sizes of the base and end pieces may be obtained by trimming, or snapping excess material.

In this embodiment, the right end cap base 710 and the left end cap base 712 and the can be trimmed to a desired width, by breaking or cutting the end cap bases along vertical grooves provided in the end cap bases.

The right end cap front 716 can be connected to the right end cap base 710 and secured with PVC cement to form a right end cap assembly 717. The left end cap front 718 can be connected to the left end cap base 712 and secured with PVC cement to form a left end cap assembly 719.

The channel plate base 720 can be broken or cut along provided grooves to a desired width.

The front lip 722 can be inserted on the under-side of the channel plate base 720 and secured with PVC cement.

The right end cap assembly 717 and the left end cap assembly 719 can be slid over the ends of the channel plate base 720 and front lip 722 and secured with the PVC cement.

In the examples of FIG. 9-13, the end cap base shows incremental sizes for width of the sill pan to be: 5¼", 5⅝", 6", 6⅜", 6 13/16", 7¼", 7⅝", or 8". Other sizes and size ranges may be provided as desired.

Figure 9:
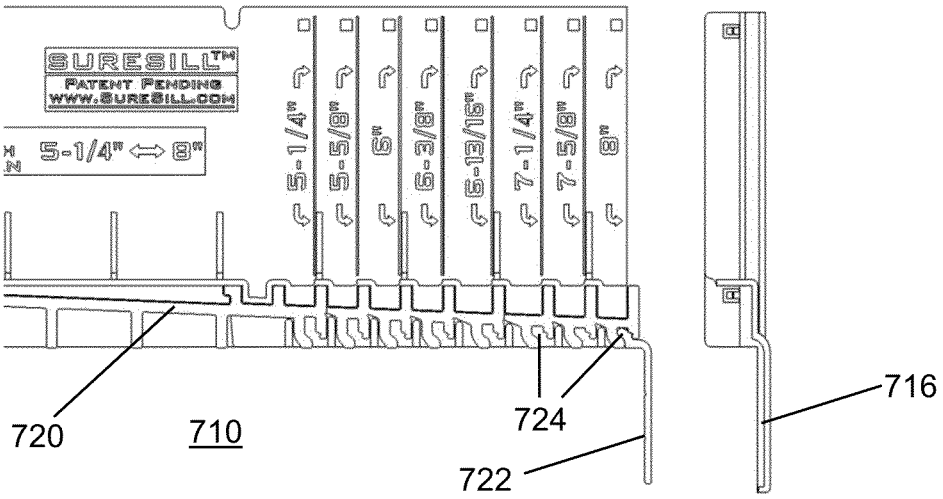
FIG. 9 is a partially exploded side view of the base and right corner of the sill pan of FIG. 8.

FIG. 9 is a partially exploded side view of the base and right corner of the sill pan of FIG. 8. FIG. 9 illustrates various width adjustment markings as grooves. FIG. 9 also indicates the various front lip insert recesses 724 for attaching the front lip 722 to the channel plate base 720.

Figure 10:
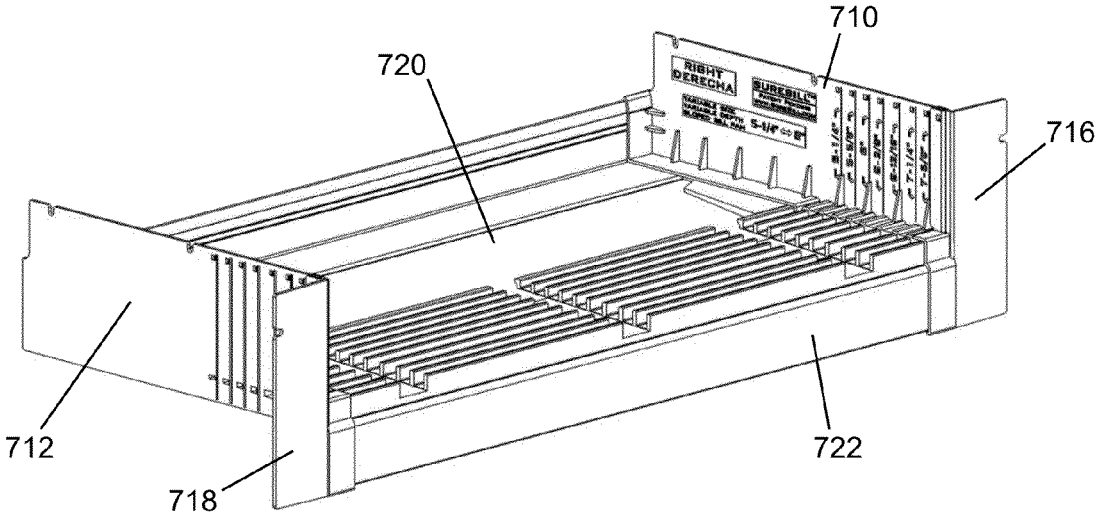
FIG. 10 is a front perspective view of assembled variable width sill pan of FIG. 8.

FIG. 10 is a front perspective view of assembled variable width sill pan of FIG. 8.

Figure 11:
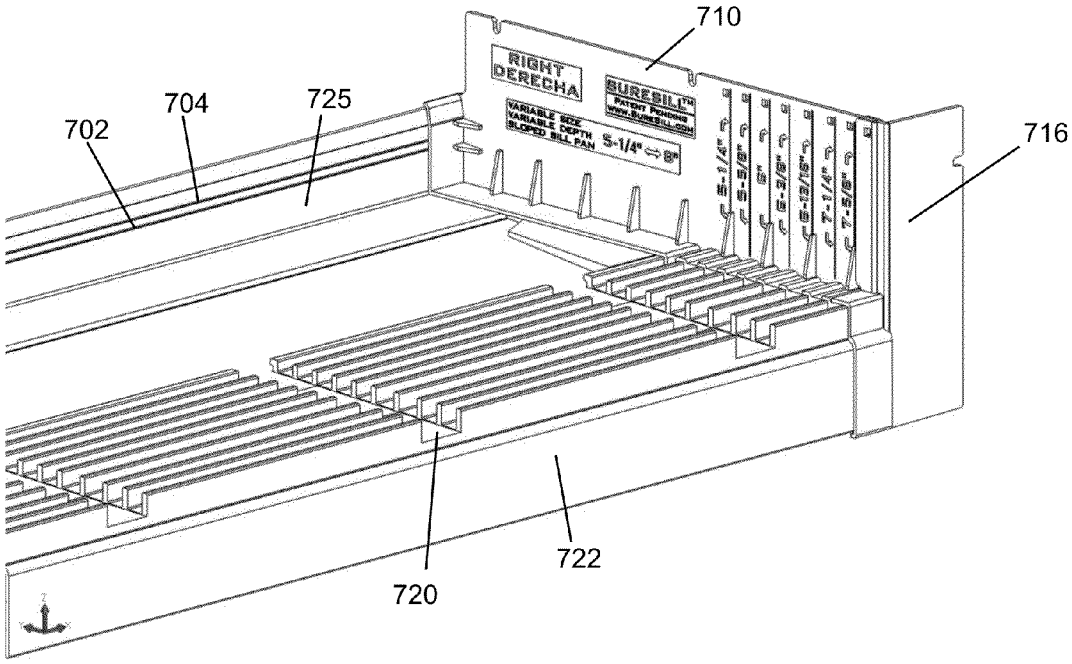
FIG. 11 is a front perspective view of the right corner portion of an assembled variable width sill pan of FIG. 8.

FIG. 11 is a front perspective view of the right corner portion of an assembled variable width sill pan of FIG. 8. This example illustrates a sill pan that has both variable height rear wall 725, and variable size or variable width from adjustable end cap 710 and channel plate base 720.

Figure 12:
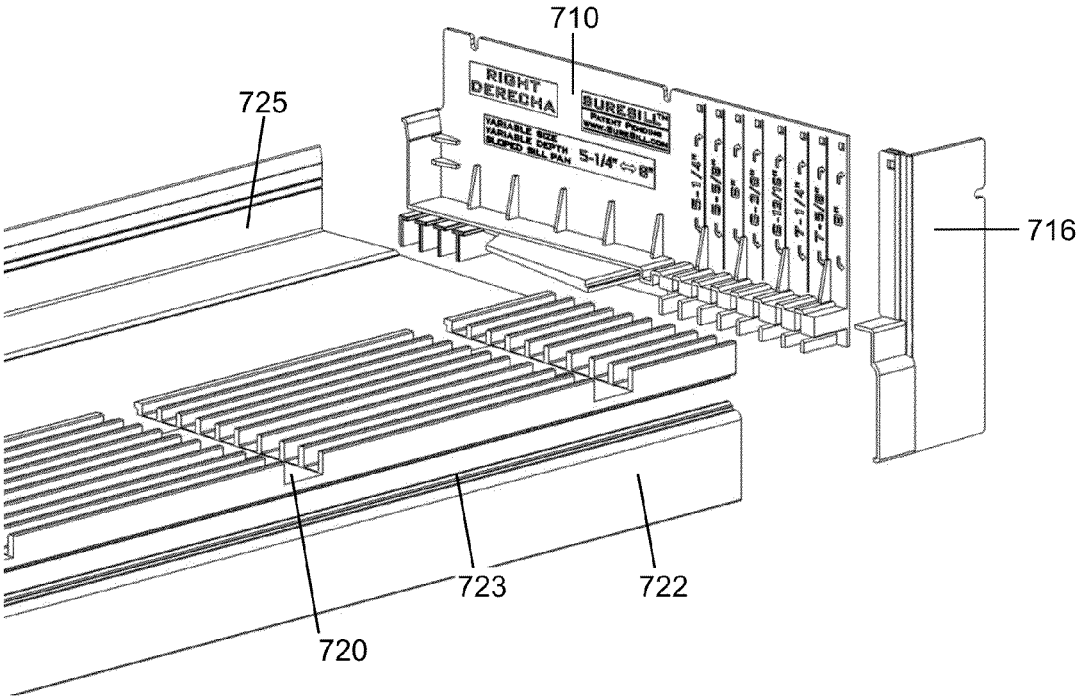
FIG. 12 is a front perspective exploded view of the right corner portion of an assembled variable width sill pan of FIG. 8.
Figure 13:
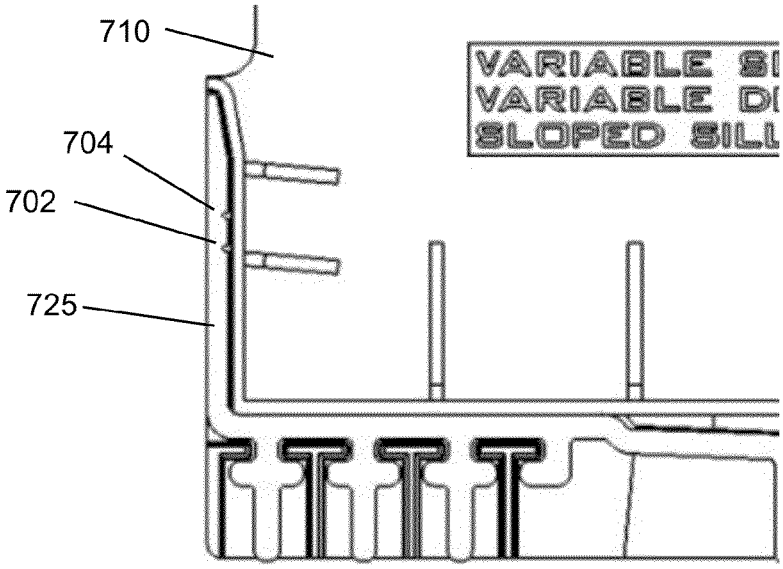
FIG. 13 is a side view detail of the overlap of a portion of the right end cap over the base of the variable width sill pan of FIG. 8.

FIG. 12 is a front perspective exploded view of the right corner portion of an assembled variable width sill pan of FIG. 8. FIG. 12 illustrates a front lip edge 723 for engaging a front lip insert recess 724.

FIG. 31 is a side view detail of the overlap of a portion of the right end cap over the base of the variable width sill pan of FIG. 26.

DETAILED DESCRIPTION OF EMBODIMENT

Variable Size Sloped Sill Pan by Adding Width Sections

In this embodiment a sill pan is provided in a first size, such as the smallest size, and can be enlarged to a desired size by adding one or more portions of the sill pan to obtain a desired width. In this example, the base of the sill pan is typically provided as an extrusion with a width of a small common sill size, and the end pieces are provided in similar widths. The end pieces are typically manufactured by injection molding or other manufacturing process. Additional sections of base or end pieces may be added by snapping or gluing the additional pieces to the original sections.

DETAILED DESCRIPTION OF EMBODIMENT

Variable Length and Width Pan

In the previous examples, a variable length pan can be obtained by cutting the base to a desired length, and attaching end pieces. In this embodiment, a variable length and variable width pan is formed by assembling prefabricated elements.

Figure 14:
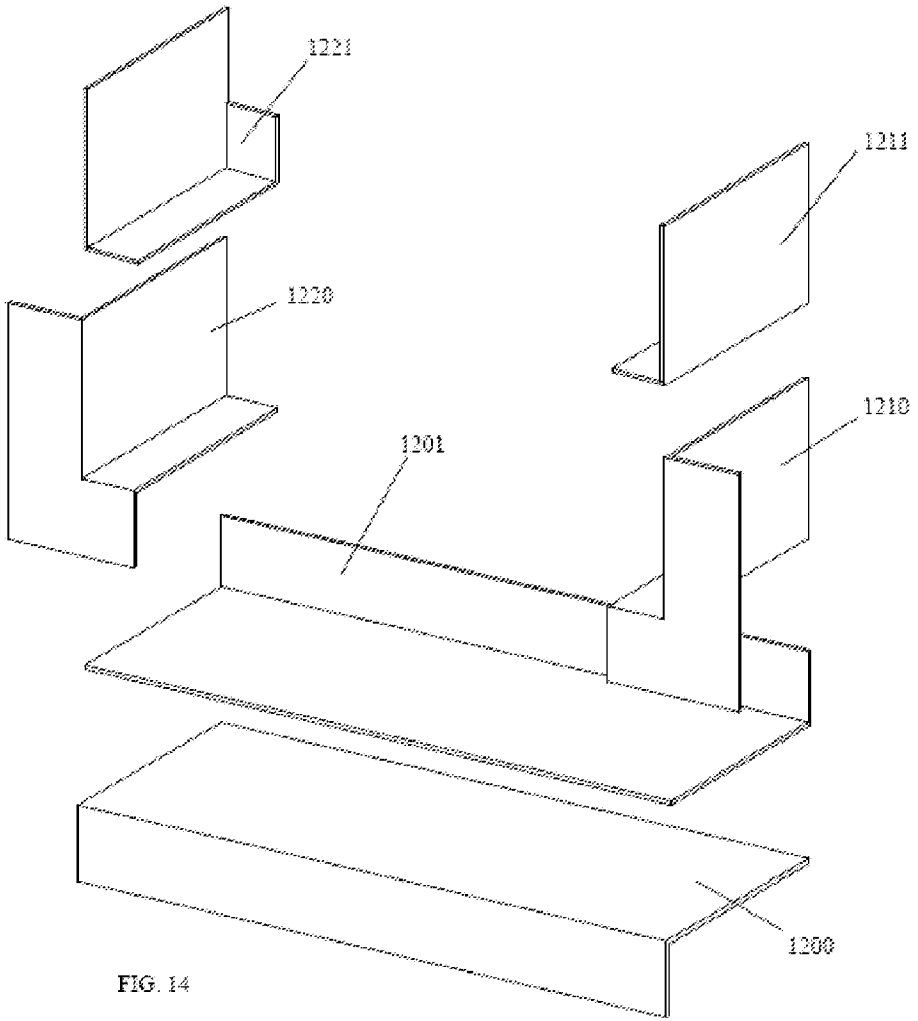
FIG. 14 is an exploded view of a variable length and variable width pan.
Figure 15:
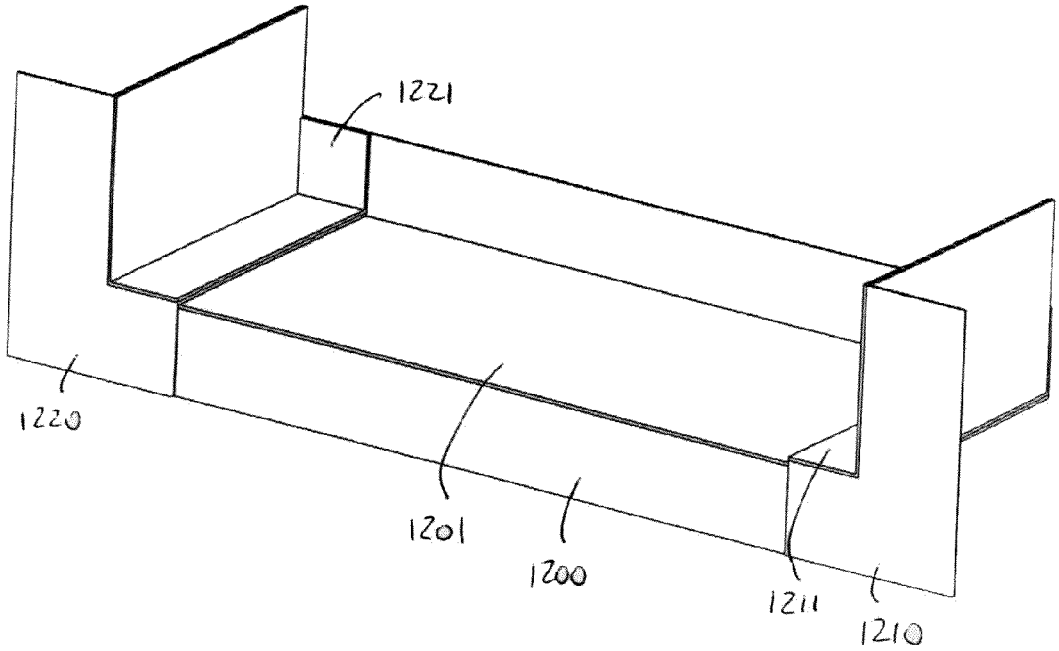
FIG. 15 is a front view of an assembled sill pan of FIG. 14.

FIG. 14 is an exploded view of a variable length and variable width pan. This example includes a base lower portion 1200, a base upper portion 1201, a first end piece lower portion 1210, a first end piece upper portion 1211, a second end piece lower portion 1220, and a second end piece upper portion 1221. FIG. 15 is a front view of an assembled sill pan of FIG. 14.

In this example, it is preferable to assembled the elements with the upper portions attached with a waterproof adhesive over the lower portions.

In this example, an installation process comprises cutting the base lower portion 1200 to a desired length, removing a portion of the base lower portion if it is too wide for the door or window opening, cutting the base upper portion 1210 to a desired length, and removing a portion of the base upper portion if it is too wide for the door or window opening. Each end piece is then cut it necessary to fit the opening width. The pieces are then assembled by gluing the base pieces together, and gluing the end pieces on top of the base.

DETAILED DESCRIPTION OF EMBODIMENT

Variable Size Sloped Sill Pan Base with Membrane Flashing Corners

In this specification, the term "membrane flashing" refers to a stretchable material which is applied to edges of the sill pan base and to the rough opening bottom corners in order to provide a barrier to moisture infiltration at the rough opening corners. Self Adhering Flashing (SAF) is one example of a membrane flashing where the stretchable material is typically provided with an adhesive and a removable backing. The backing may be removed so that a portion of the SAF may be applied to the sill pan base and to the inside of the rough opening. Another portion of the flashing is then bent over part of the outside of the side and bottom of the rough opening.

This embodiment permits a single sill pan base to be adapted to sill pan widths of 3¼", 3⅝", 4⅛", 4 9/16", 5¼", 5¾", 6⅛", 6 9/16", 6 13/16", and 7¼".

Figure 16A:
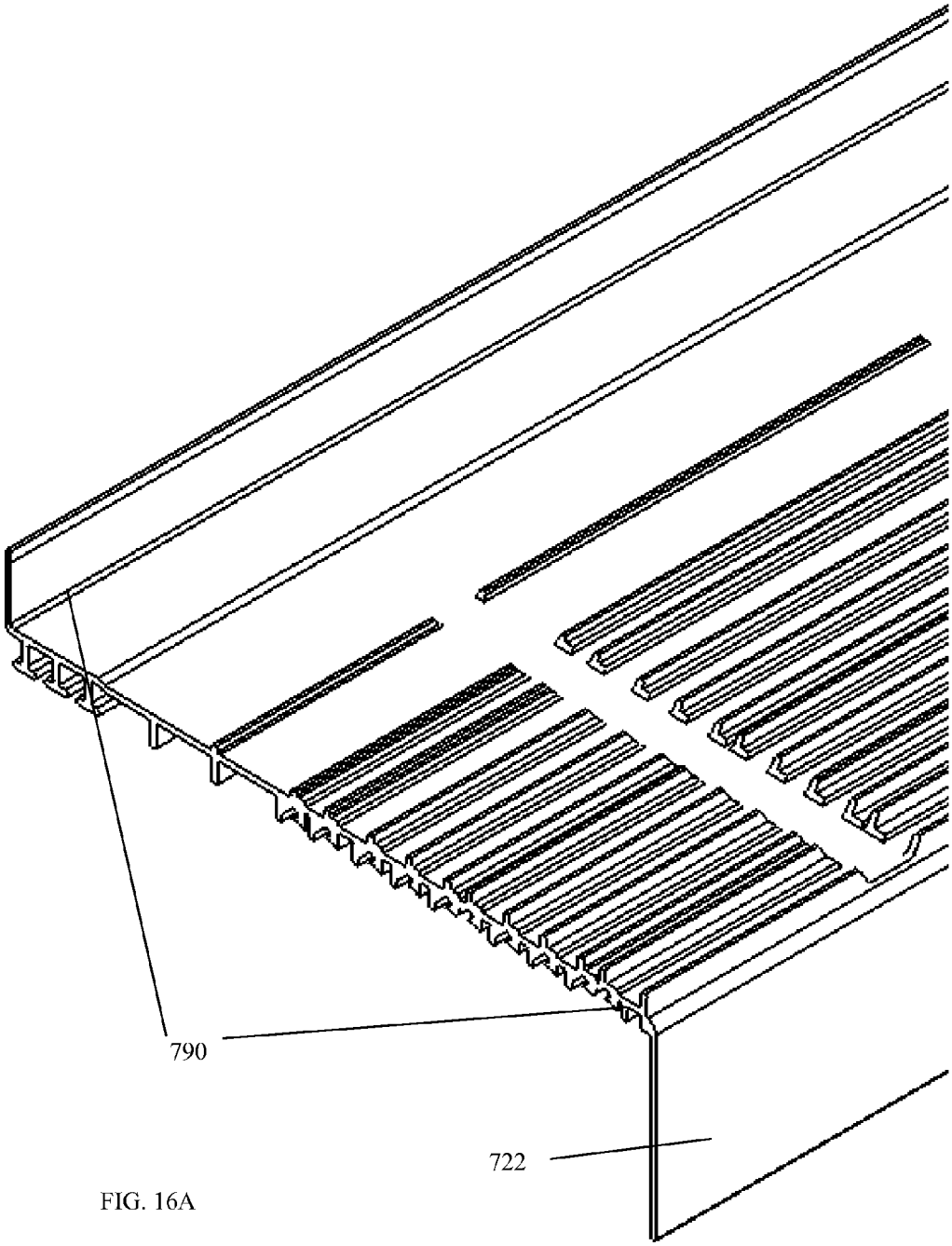
FIG. 16A is a side perspective view of an example 7¼" embodiment of a variable size sill pan base.
Figure 16B:
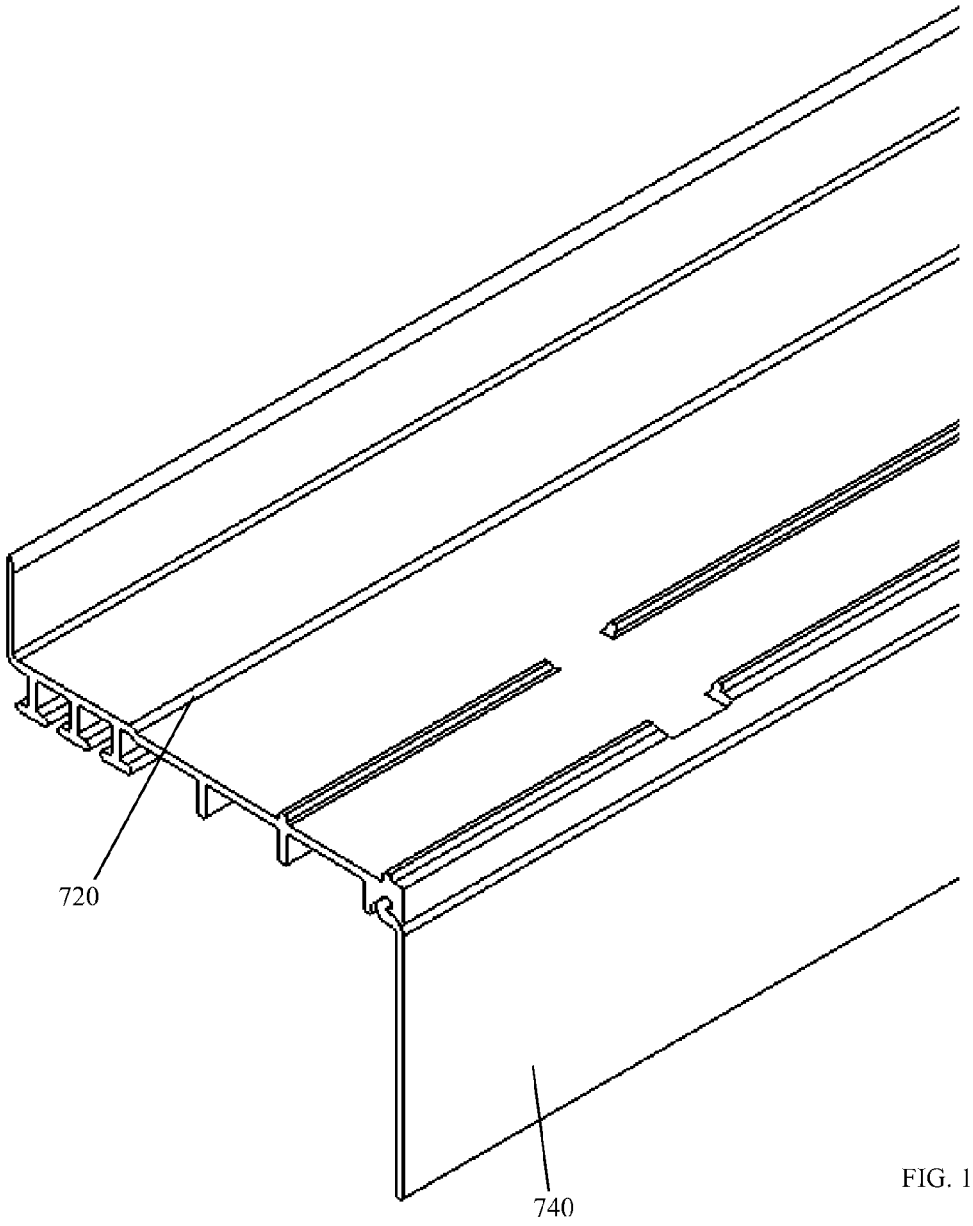
FIG. 16B is a side perspective view of the sill pan base of FIG. 16A broken or cut to a desired 3¼" sill pan depth with a spare front lip inserted into a bottom channel.

FIG. 16A is a side perspective view of an example 7¼" sill pan base 720 and integral lip 722 of a variable size sill pan base unit 790. FIG. 16B is a side perspective view of the sill pan base of FIG. 16A broken or cut to a desired 3¼" sill pan depth with a spare front lip 740 inserted into a bottom channel. In this example, the spare front lip 740 comprises a top edge 742 which may be inserted into any of a plurality of front lip insert recesses (lip grooves) **760*a*-760*i* provided on the bottom of the sill pan base 720, and a downwardly extending plate 744**.

Figure 16C:
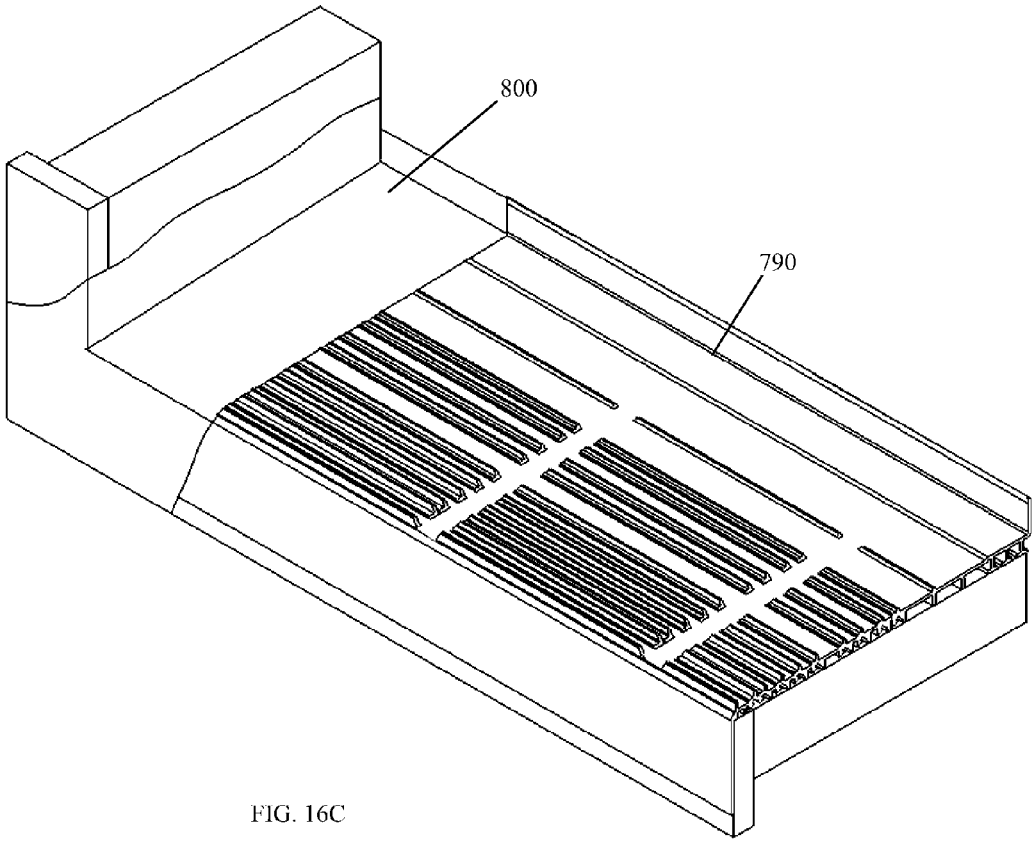
FIG. 16C is a front perspective view of a Self Adhering Flashing (SAF) applied over the corner of sill pan base of FIG. 16A.
Figure 16D:
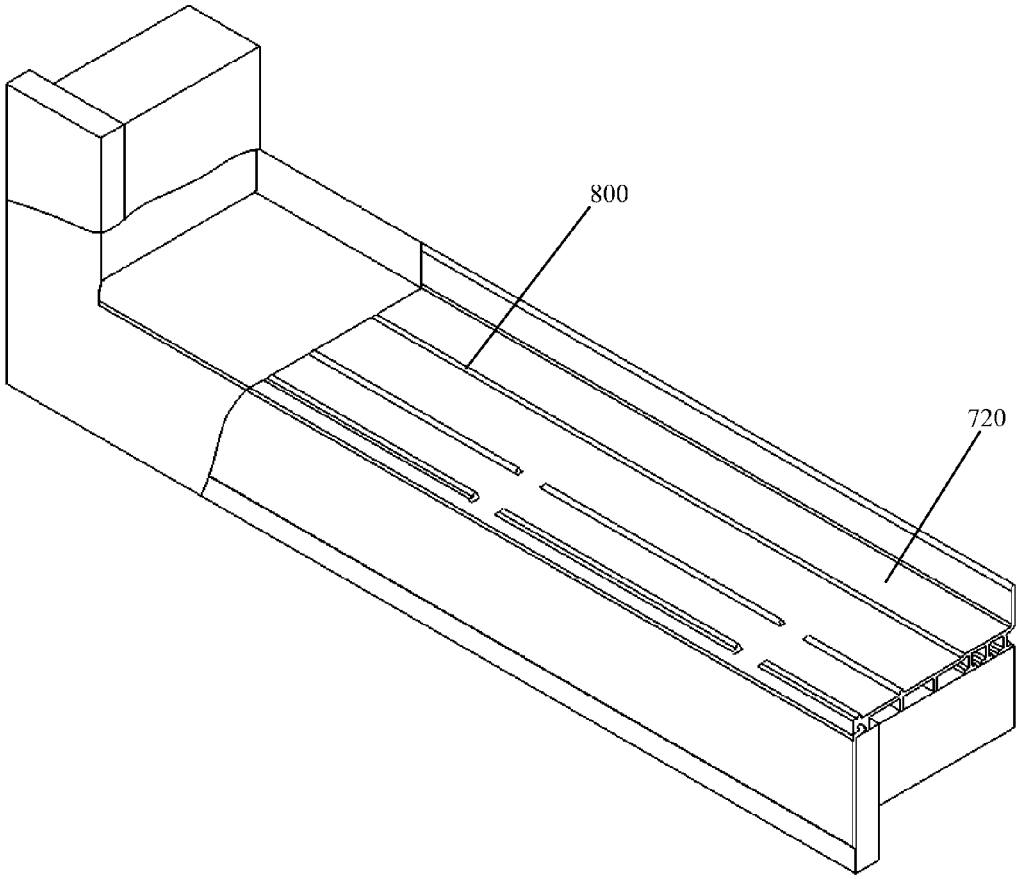
FIG. 16D is a front perspective view of a Self Adhering Flashing (SAF) applied over the corner of sill pan base of FIG. 16B.

FIG. 16C is a front perspective view of a Self Adhering Flashing (SAF) 800 applied over the left corner of the sill pan base 720 of FIG. 16A. FIG. 16D is a front perspective view of a Self Adhering Flashing (SAF) applied over the left corner of sill pan base of FIG. 16B.

FIG. 17A is a side view of an example 7¼" embodiment of a variable size sill pan base and a spare lip. This FIG. shows a plurality of scoring grooves **750*a*-750*i*** to permit the sill pan base to be cut or broken to a desired depth.

FIG. 17B is a side view of the sill pan base of FIG. 17A broken or cut along the 6 13/16" score groove **750*a*, and the spare lip inserted into the 6 13/16" lip groove 760*a***.

FIG. 17C is a detailed side view of the end of the sill pan base of FIG. 17A, the spare lip inserted, and a sealant 770 applied along the gap where the spare lip 740 is inserted into the 6 13/16" lip groove **760*a***.

FIG. 17D is a side view of the sill pan base of FIG. 17A broken or cut along the 6 9/16" score grove **750*b*, and the spare lip inserted into the 6 9/16" lip groove 760*b***.

FIG. 17E is a side view of the sill pan base of FIG. 17A broken or cut along the 6⅛" score grove **750*c*, and the spare lip inserted into the 6⅛" lip groove 760*c***.

Figure 17F:
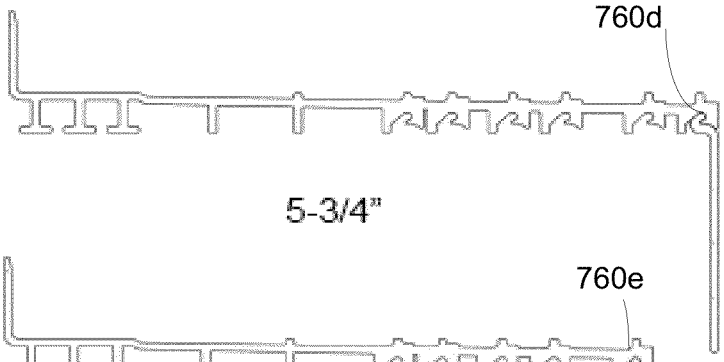
FIG. 17F is a side view of the sill pan base of FIG. 17A broken or cut along the 5¾" score groove, and the spare lip inserted into the 5¾" lip groove.

FIG. 17F is a side view of the sill pan base of FIG. 17A broken or cut along the 5¾" score grove **750*d*, and the spare lip inserted into the 5¾" lip groove 760*d***.

Figure 17G:
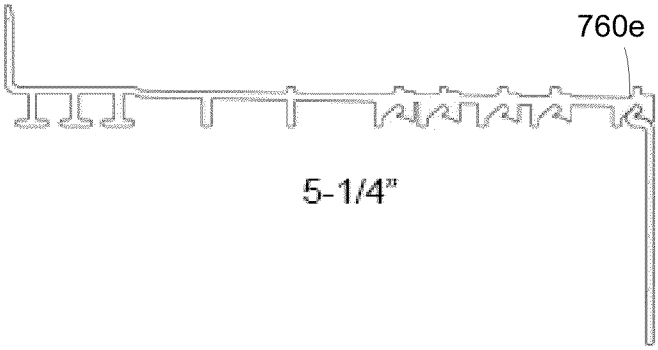
FIG. 17G is a side view of the sill pan base of FIG. 17A broken or cut along the 5¼" score groove, and the spare lip inserted into the 5¼" lip groove.

FIG. 17G is a side view of the sill pan base of FIG. 17A broken or cut along the 5¼" score grove 750*e*, and the spare lip inserted into the 5¼" lip groove 760*e*.

Figure 17H:
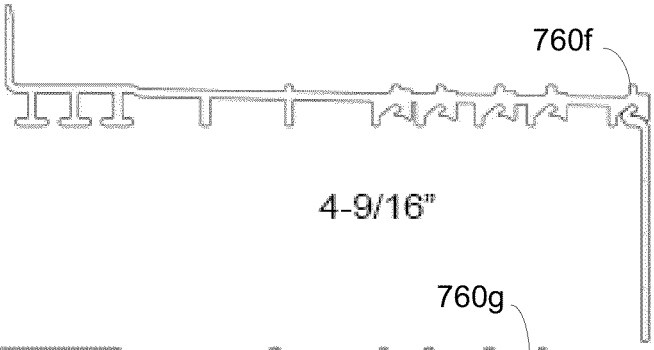
FIG. 17H is a side view of the sill pan base of FIG. 17A broken or cut along the 4⁹⁄₁₆" score groove, and the spare lip inserted into the 4⁹⁄₁₆" lip groove.

FIG. 17H is a side view of the sill pan base of FIG. 17A broken or cut along the 4⁹⁄₁₆" score grove 750*f*, and the spare lip inserted into the 4⁹⁄₁₆" lip groove 760*f*.

Figure 17I:
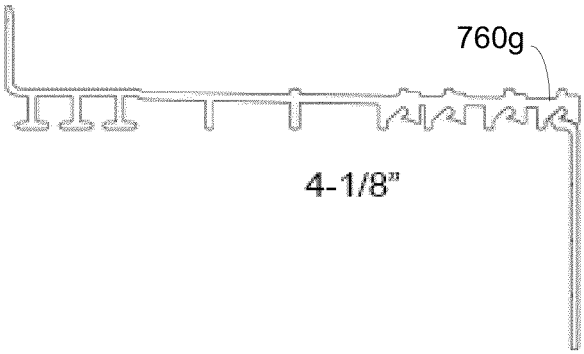
FIG. 17I is a side view of the sill pan base of FIG. 17A broken or cut along the 4⅛" score groove, and the spare lip inserted into the ⁴⁄₁₈" lip groove.

FIG. 17I is a side view of the sill pan base of FIG. 17A broken or cut along the 4⅛" score grove 750*g*, and the spare lip inserted into the ⁴⁄₁₈" lip groove 760*g*.

Figure 17J:
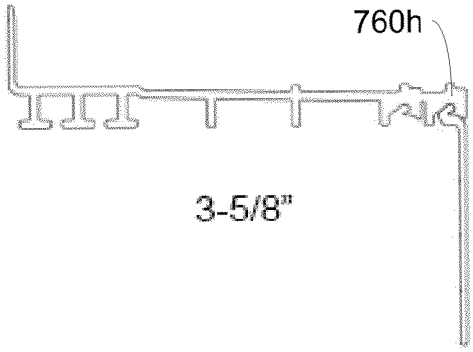
FIG. 17J is a side view of the sill pan base of FIG. 17A broken or cut along the 3⅝" score groove, and the spare lip inserted into the 3⅝" lip groove.

FIG. 17J is a side view of the sill pan base of FIG. 17A broken or cut along the 3⅝" score grove 750*h*, and the spare lip inserted into the 3⅝" lip groove 760*h*.

Figure 17K:
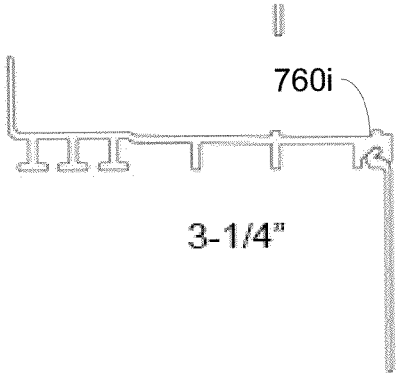
FIG. 17K is a side view of the sill pan base of FIG. 17A broken or cut along the 3¼" score groove, and the spare lip inserted into the 3¼" lip groove.

FIG. 17K is a side view of the sill pan base of FIG. 17A broken or cut along the 3¼" score grove 750*i*, and the spare lip inserted into the 3¼" lip groove 760*i*.

One method of sill pan installation is described in FIGS. 18A-18K. FIG. 18A is a front perspective view of a sealant applied to the bottom 810 and front 820 of a rough opening 800. FIG. 18B is a detailed front perspective of a corner of the rough opening 800 of FIG. 18A. FIG. 18C is a front perspective view of a variable size sill pan base unit 790 positioned in the bottom of the rough opening 800 of FIG. 18A. FIG. 18D is a detailed front perspective of the left corner of the sill pan base 720 of FIG. 18C, showing a fastener location 791 and a first drain channel 793 on the left side of the sill pan base 720. It is generally desirable to extend the membrane to the first drain channel 792 in order to provide a continuous drainage path moisture removal.

FIG. 18E is a detailed front perspective of the right corner of the sill pan base of FIG. 18C, showing a fastener location 792 and a drain channel 794 on the right side of the sill pan base. FIG. 18F is a front perspective view of a Self Adhering Flashing 850*a* and 850*b* applied to the left and right ends of the sill pan base of FIG. 18C. FIG. 18G is a detailed front perspective view of the Self Adhering Flashing applied to the left end of the sill pan base of FIG. 18C and to the inside of the left bottom corner 801 of the rough opening. FIG. 18H is a front perspective view of portions of the Self Adhering Flashing 850*a* folded over portions of the front side and bottom of the rough opening. FIG. 18I is a detailed rear perspective view of the left corner Self Adhering Flashing 850*b* folded over outside portions of the rear side 812 and bottom 810 of the rough opening. In a similar fashion, a portion of flashing 850*b* is folded over the rear side and bottom of the opposite corner.

DETAILED DESCRIPTION OF EMBODIMENT

Variable Size Sloped Sill Pan Base with Adhesive Corners

In this embodiment, the sill pan is adjusted to a desired width and installed in the rough opening as described above. A liquid adhesive is applied over the end portions of the sill pan base and to the inside bottom corners of the rough opening. A continuous coating of adhesive is also applied to the outside of the sides and bottoms of the rough opening bottom corners. It is generally desirable to extend the adhesive coating to the first drain channels on each end of the sill pan base in order to provide a continuous drainage path moisture removal.

What is claimed is:

1. A method for adjusting the width of a sill pan base, the method comprising providing a sill pan kit comprising a sill pan base having a length and a width, the base comprising a first end, a second end, and a plurality of base width adjustment indicators, and a plurality of front lip insert recesses, and a front lip including a front lip top edge which is insertable into a selected front lip insert recess;

selecting one of the plurality of base width adjustment indicators;

breaking or cutting the sill pan base along the selected base width indicator; and inserting the top edge of the front lip into the selected front lip insert recess.

2. The method of claim 1 further comprising cutting the sill pan base to a desired length.

3. A method for installing a width-adjustable sill pan in a rough opening, the rough opening having an outside, an inside, a bottom, a first side, a second side, a first bottom corner, and a second bottom corner, the method comprising providing a sill pan kit comprising a sill pan base having a length and a width, the base comprising a first end, a second end, and a plurality of base width adjustment indicators, and a plurality of front lip insert recesses, and a front lip including a front lip top edge which is insertable into a selected front lip insert recess;

adjusting the width of the sill pan base by selecting one of the plurality of base width adjustment indicators, breaking or cutting the sill pan base along the selected base width indicator, and inserting the top edge of the front lip into the selected front lip insert recess;

installing the sill pan base in the bottom of a rough opening; and providing rough opening corner sealing at the first end and second end of the sill pan base.

4. The method of claim 3 wherein installing the sill pan base in the bottom of a rough opening further comprises applying a sealant to the bottom and front surfaces of the rough opening;

positioning the sill pan base in the rough opening; and using fasteners in proximity to the first end and to the second end of the sill pan base.

5. The method of claim 3 wherein adjusting the width of the sill pan base further comprises applying a sealant to the sill pan base along the selected front lip insert recess.

6. The method of claim 3 wherein providing rough opening corner sealing at the first end and second end of the sill pan base further comprises applying a first membrane flashing to the first end of the sill pan and to the first bottom corner of the rough opening; and applying a second membrane flashing to the second end of the sill pan and to the second bottom corner of the rough opening.

7. The method of claim 6 wherein the first membrane flashing is Self Adhering Flashing; and the second membrane flashing is Self Adhering Flashing.

8. The method of claim 6 wherein the first membrane flashing is applied to cover a first drain channel on the sill pan base in order to provide a continuous drain path; and the second membrane flashing is applied to cover a second drain channel on the sill pan base in order to provide a continuous drain path.

9. The method of claim 3 wherein providing rough opening corner sealing at the first end and second end of the sill pan base further comprises applying an adhesive to the first end of the sill pan and to the first bottom corner of the rough opening; and applying an adhesive to the second end of the sill pan and to the second bottom corner of the rough opening.

10. The method of claim 3 wherein providing rough opening corner sealing at the first end and second end of the sill pan base further comprises providing a first and a second adjustable width end piece;

adjusting the width of the first and a second adjustable width end piece;

attaching the first end piece on the first end of the sill pan base; and attaching the second end piece on the second end of the sill pan base.

11. The method of claim 10 wherein providing a first and a second adjustable width end piece further comprises providing a first end piece assembly comprising a first end piece base including a plurality of width adjustment indicators, and a first end piece cap front, and providing a second end piece assembly comprising a second end piece base including a plurality of width adjustment indicators, and a second end piece cap front; and adjusting the width of the first and a second adjustable width end piece further comprises selecting one of the plurality of first end piece width adjustment indicators, breaking or cutting the first end piece base along the selected first end piece width adjustment indicator, assembling the front of the first end piece to the first end piece base, selecting one of the plurality of second end piece width adjustment indicators, breaking or cutting the second end piece base along the selected second end piece width adjustment indicator, and assembling the front of the second end piece to the second end piece base.

* * * * *